US009573138B2

(12) United States Patent
Assmann et al.

(10) Patent No.: US 9,573,138 B2
(45) Date of Patent: Feb. 21, 2017

(54) ROLLER MILL AND METHOD FOR OPERATING A ROLLER MILL

(71) Applicant: THYSSENKRUPP RESOURCE TECHNOLOGIES GMBH, Beckum (DE)

(72) Inventors: Bjoern Olaf Assmann, Hamm (DE); Joerg Petring, Lingen (DE); Guido Kache, Beckum (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 242 days.

(21) Appl. No.: 14/376,817

(22) PCT Filed: Jan. 22, 2013

(86) PCT No.: PCT/EP2013/051133

§ 371 (c)(1),
(2) Date: Aug. 5, 2014

(87) PCT Pub. No.: WO2013/117423

PCT Pub. Date: Aug. 15, 2013

(65) Prior Publication Data

US 2015/0014452 A1 Jan. 15, 2015

(30) Foreign Application Priority Data

Feb. 6, 2012 (DE) ..... 10 2012 100 946

(51) Int. Cl.
*B02C 23/18* (2006.01)
*B02C 15/04* (2006.01)
*B02C 15/00* (2006.01)

(52) U.S. Cl.
CPC ..... *B02C 23/18* (2013.01); *B02C 15/00* (2013.01); *B02C 15/007* (2013.01); *B02C 15/04* (2013.01)

(58) Field of Classification Search
CPC ..... B02C 23/18; B02C 15/007; B02C 15/00; B02C 15/04
(Continued)

(56) References Cited

U.S. PATENT DOCUMENTS 3,647,140 A 3/1972 Perrot et al.
4,349,158 A * 9/1982 Broman ..... B02C 15/04 241/117
4,379,523 A 4/1983 Schanz et al.
6,193,176 B1 2/2001 Mitsuda et al.

FOREIGN PATENT DOCUMENTS

CN 201161202 Y 12/2008
CN 201524599 U 7/2010
(Continued)

OTHER PUBLICATIONS

German Language International Search Report for PCT/EP2013/051133; mailing date Oct. 30, 2013.
(Continued)

*Primary Examiner* — Mark Rosenbaum
(74) *Attorney, Agent, or Firm* — thyssenkrupp North America, Inc.

(57) ABSTRACT

The roller mill for grinding of material to be ground prescribed by the invention has a grinding table and at least one grinding roller which works with the grinding table, whereby a water lance for applying water to the material to be ground is placed in the rotation direction of the grinding table in front of the grinding roller. The water lance is designed to rotate and means for rotating the water lance are provided in order to specifically influence the exposure time of the water to the material to be ground before the material to be ground is gathered by the grinding roller.

10 Claims, 5 Drawing Sheets

(58) Field of Classification Search
USPC ..... 241/117–121
See application file for complete search history.

(56) References Cited

FOREIGN PATENT DOCUMENTS

| | | | |
|---|---|---|---|
| DE | 69807268 | T2 | 4/2003 |
| EP | 0858839 | A1 | 8/1998 |
| JP | S51-163172 | | 12/1976 |
| JP | S57-87861 | A | 8/1982 |
| JP | S61-79651 | | 5/1986 |
| JP | H07204528 | A | 8/1995 |
| JP | 2000-140663 | A | 5/2000 |
| JP | 2000157882 | A | 6/2000 |

OTHER PUBLICATIONS

English Translation of International Search Report for PCT/EP2013/051133; mailing date Oct. 30, 2013.
English Language Abstract for Japanese patent application No. JP H07204528.
English Language Abstract for Japanese patent application No. JP 2000157882.
English Language Abstract for CN201161202 (Y).
English Language Abstract for Cn 201524599 (U).
German language Wikipedia article for "Collie (Western Australia)", Jan. 4, 2015, located at https://de.wikipedia.org/w/index.php?title=Collie_(Western_Australia)&oldid=137427017.
English machine translation of the text of German language Wikipedia article for "Collie (Western Australia)", Jan. 1, 2015, located at https://de.wikipedia.org/w/index.php?title=Collie_(Western_Australia)&oldid=I37427017.
List of drawings from Babcock, dated Jul. 4, 1996, and accompanying drawing of water injection nozzle installed at a Power Station in Collie, Australia that was referred to in the above identified Wikipedia article.
Catalog pages from Gustav Schlick showing various embodiments of their model 650 spray nozzle.
English Language Abstract for JP S61-79651.
English Language Abstract for JP S51-163172.
English Language Abstract for JP 2000-140663.

* cited by examiner

ROLLER MILL AND METHOD FOR OPERATING A ROLLER MILL

CROSS REFERENCE TO RELATED APPLICATIONS

This application is a U.S. National Stage Entry of International Patent Application Serial Number PCT/EP2013/051133, filed Jan. 22, 2013, which claims priority to German Patent Application Serial No. DE 102012100946.5, filed Feb. 6, 2012.

FIELD

The invention relates to a roller mill for grinding of material to be ground with a grinding table and at least one grinding roller working with the grinding table as well as a procedure for operating such a roller mill

BACKGROUND

For roller mills, the material to be ground is usually placed centrally and moves to the outside through centrifugal force and there it is gathered by the grinding rollers unrolling on the grinding table. From the EP 0 858 839 A1 it is already known that the moistening of the material to be ground results in a stabilisation of the grinding bed and in this way the smooth running of the roller mill and the efficiency of grinding can be improved. It is known that you must add the water to the grinding table together with the material to be ground or directly at the point of application. In the EP 0 858 839 A1 a water lance is used which is arranged in the rotation direction of the grinding table in front of the grinding roller.

However, it has been found that the product quality is negatively affected by excessive injected water flow rates. In addition, the availability of water can be limited locally.

Therefore in JP 2000157882 A, the flow rate of the sprayed water is regulated by using a vibration sensor. If a certain vibration level is exceeded, the injected water flow is increased and vice versa.

SUMMARY

The invention is therefore based on the task of making the placement of the water on the grinding bed more efficient, on the one hand to positively influence the smoothness of the roller mill as well as to optimize the efficiency of the grinding and the throughput of the roller mill and on the other hand to make do with the smallest possible volume of water flows.

According to the invention this problem is solved by the features of claims 1 and 6.

BRIEF DESCRIPTION OF THE DRAWINGS

The present disclosure is described in detail below with reference to the attached drawing figure, wherein.

DETAILED DESCRIPTION

Figure 1:
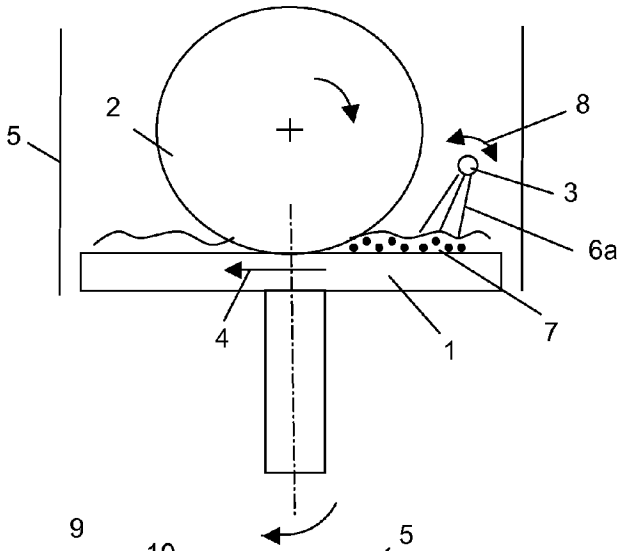
FIG. 1 is a schematic side view depicting an embodiment of a roller mill with a water lance of the present disclosure.

The roller mill for grinding of material to be ground prescribed by the invention has a grinding table and at least one grinding roller which works with the grinding table, whereby a water lance for applying water to the material to be ground is placed in the rotation direction of the grinding table in front of the grinding roller. The water lance is thereby designed to rotate and means for rotating the water lance are provided in order to specifically influence the exposure time of the water to the material to be ground before the material to be ground is gathered by the grinding roller.

To operate the roller mill as prescribed by the invention, a grinding table and at least one grinding roller which works with the grinding table are provided. Furthermore, water is applied to the material to be ground via a water lance arranged in the rotation direction of the grinding table in front of the grinding roller. The exposure time of the water to the material to be ground before the grinding roller gathers the material to be ground is influenced by the fact that the interval between the water landing on the material to be ground and the gathering of the material to be ground by the grinding roller can be specifically set by rotating the water lance.

In the trials on which the invention is based, it was found that the exposure time of the water to the material to be ground before the material to be ground is gathered by the grinding roller has a major influence on the smooth operation. Furthermore, it was found that the flow of material to be ground gets from the centre to the grinding track through centrifugal force very differently depending on the composition of the material to be ground. In order to apply the water to be sprayed on the material to be ground as effectively as possible, according to the invention, the rotation of the water lance is recommended. In this way, the interval between the water jets landing on the material to be ground can be specifically adjusted by the grinding roller to the prevailing conditions.

Further configurations from the invention are the subject of the dependent claims.

The water lance usefully has multiple nozzles with nozzle axles aligned in the direction of the grinding table in order to cover the entire width of the flow of material to be ground to be gathered by the grinding roller.

To influence the exposure time of the water to the material to be ground, the means for rotating the water lance are formed in such a way that the interval between the water landing on the material to be ground and the gathering of the material to be ground by the grinding roller can be adjusted by rotating the water lance. On the grinding table, a grinding track is created in the operating area of the grinding roller, whereby the water lance usefully extends across this grinding track and thereby radially to the grinding table. Furthermore, it can be envisaged that the water lance is additionally arranged so that it can slide in the direction of its longitudinal extension. In this way, a further adjustment and alignment of the water jets is possible. In addition, the lance can be taken out of the grinding chamber in this way for maintenance and/or repair. If this is possible during operation, the grinding process must not be interrupted.

The rotation of the water lance usefully takes place subject to at least one operating parameter (e.g. variations in the power consumption of the drive, fluctuations in hydraulic pressure, grinding bed height, theoretical charge shoulder of the grinding rollers).

Further configurations of the invention are explained in more detail below with reference to the description and the drawing.

Figure 2:
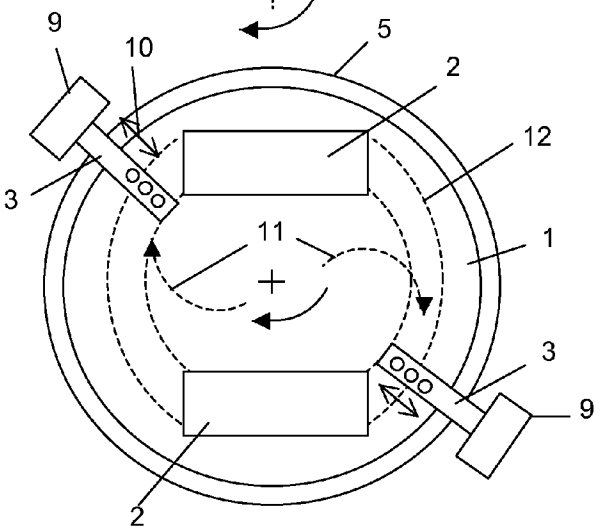
FIG. 2 is a schematic top plan view depicting an embodiment of the roller mill of FIG. 1.

The roller mill shown in FIGS. 1 and 2 essentially comprises a grinding table 1 and two grinding rollers 2 which work with the grinding table.

Furthermore, each grinding roller 2 is assigned a water lance 3, which is arranged in the rotation direction of the grinding table 1 in front of each grinding roller 2. The grinding roller 2 and the grinding table 1 are arranged in a grinding chamber confined by the mill housing 5.

Figure 3:
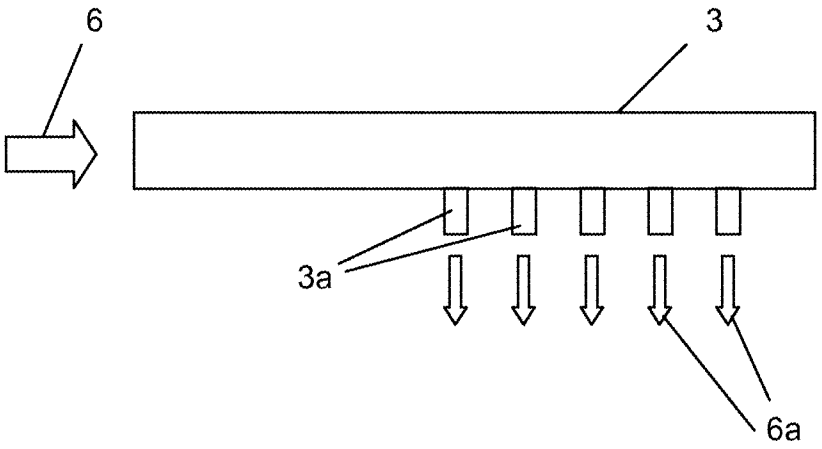
FIG. 3 is a schematic side view of an embodiment of a water lance of the present disclosure.
Figure 5B:
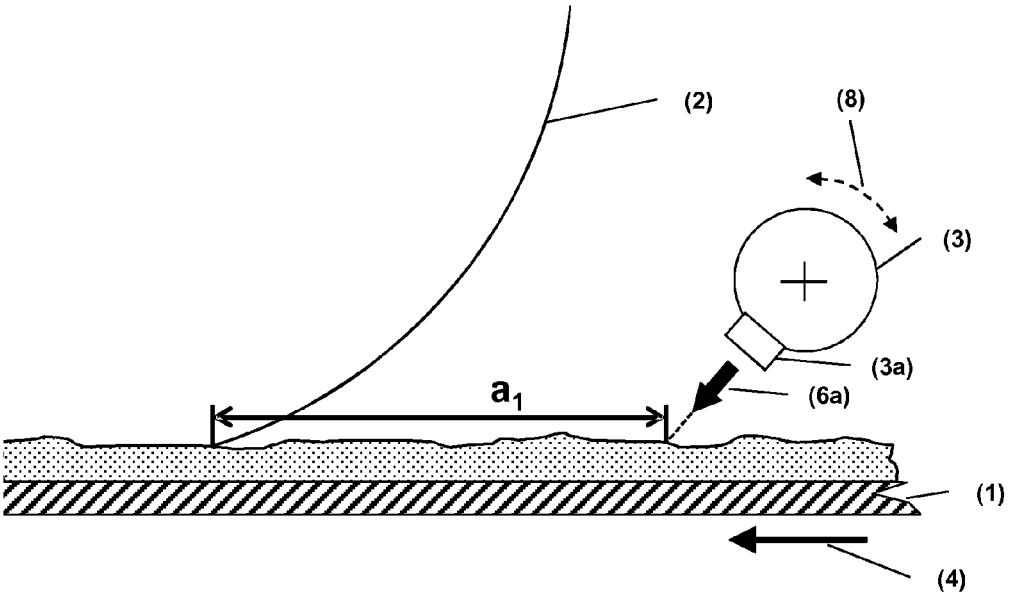
FIG. 5*b* is a partial schematic side view of the roller mill and water lance of FIG. 5*a* disposed in the alternate second operating position.
Figure 6A:
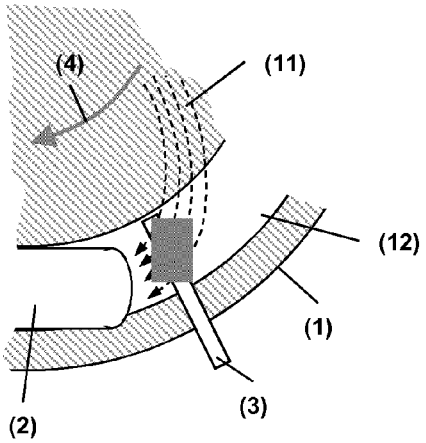
FIG. 6*a* is a partial schematic top plan view depicting an embodiment of a roller mill of the present disclosure having a water lance disposed in an alternate third operating position.
Figure 6B:
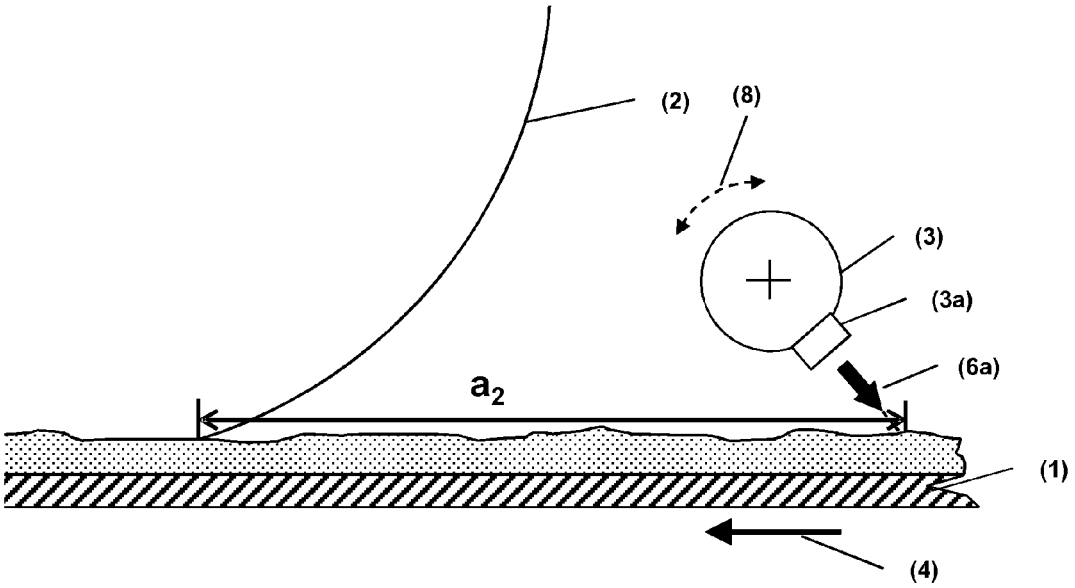
FIG. 6*b* is a partial schematic side view of the roller mill and water lance of FIG. 6*a* disposed in the alternate third operating position.

The water lance 3, shown in more detail in FIG. 3, is designed here as an elongated piece of pipe that has multiple nozzles 3*a* on the side facing the grinding table 1. The water 6 supplied to the water lance 3 is sprayed in the form of water jets 6*a* from the nozzles 3*a* onto the material to be ground 7 fed onto the grinding table 1. The water lance can be rotated via means 9 as indicated by the double arrow 8 (FIG. 1). The nozzles 3*a* of the water lance 3 can thereby especially occupy the position shown in FIGS. 4*b*, 5*b* and 6*b* in relation to the grinding table 1 and the associated grinding roller 2. In addition to the rotational movement as indicated by the double arrow 8, the water lance is also arranged so that it can slide in its longitudinal direction as indicated by the double arrow 10 and can therefore also be removed from the mill housing 5, for example for maintenance or repair reasons. The adjustment as shown by the double arrows 8 and 10 can thereby take place while the milling process is ongoing.

Figure 4A:
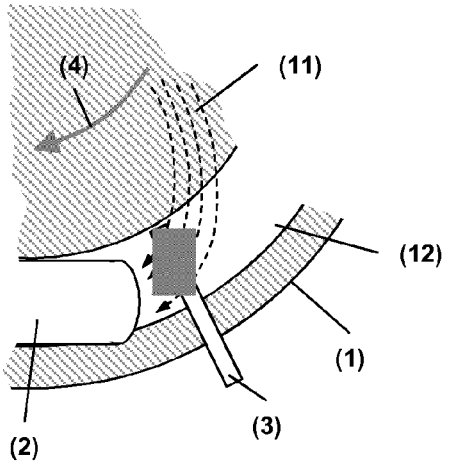
FIG. 4*a* is a partial schematic top plan view depicting an embodiment of a roller mill of the present disclosure having a water lance disposed in an initial operating position.
Figure 4B:
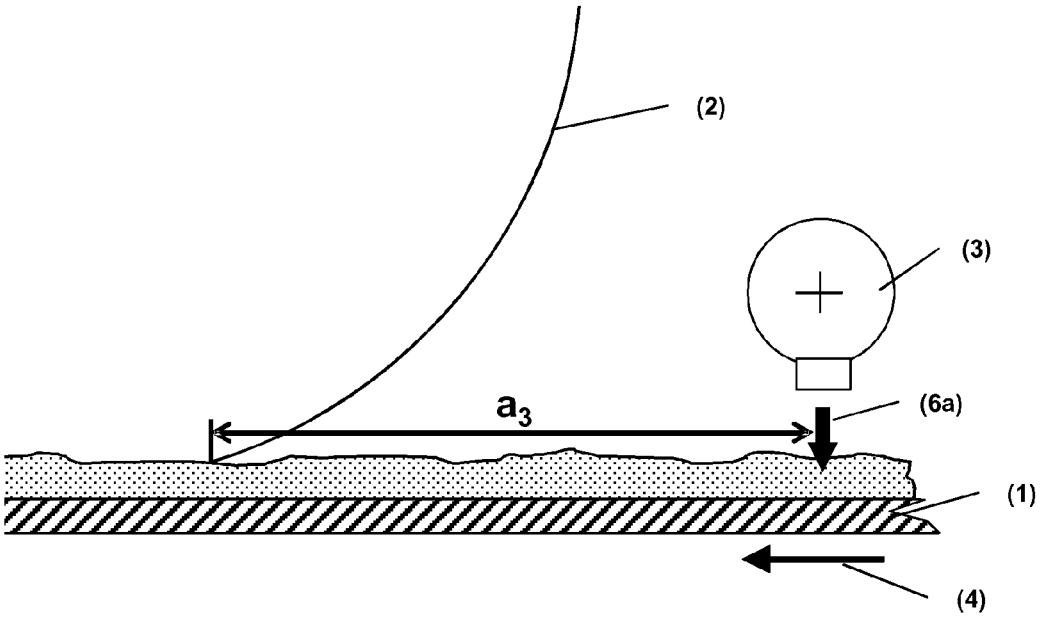
FIG. 4*b* is a partial schematic side view of the roller mill and water lance of FIG. 4*a* disposed in the initial operating position.
Figure 5A:
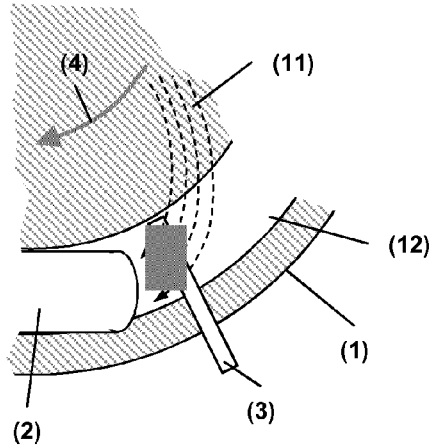
FIG. 5*a* is a partial schematic top plan view depicting an embodiment of a roller mill of the present disclosure having a water lance disposed in an alternate second operating position.

The material to be ground 7 is usually placed centrally on the grinding table 1 and moves to the outside due to the centrifugal force as indicated by the dashed arrows 11 where it comes to the part of the grinding track 12 on which the grinding rollers 2 unroll on the grinding table 1. Depending on the rotary speed of the grinding table 1 and the nature of the material to be ground 7, the location and direction with which the material to be ground 7 gets to the grinding track area is different, as is shown schematically in FIGS. 4*a*, 5*a* and 6*a* for three different situations. By a rotation of the water lance as indicated by the double arrow 8, the interval between the impact of the water jets 6*a* on the material to be ground and the gathering of the material to be ground by the grinding roller can be changed. In the position shown in FIGS. 5*a* and 5*b*, this interval $a_1$ is the shortest and in the position shown in FIGS. 6*a* and 6*b* (interval $a_2$) it is the longest, while FIGS. 4*a* and 4*b* show an average interval $a_3$. Through the radially adjustable and axially rotatable water lance 3, the impact area of the water jets on the material to be ground 7 can be specifically influenced. In this way, the water injection can be optimally adjusted to the currently existing operating conditions of the roller mill. The exposure time of the water to the material to be ground 7 until the gathering by the grinding roller can be specifically influenced and the water injection can be focused on a locally limited area. Consequently, the necessary flow rate for stabilization of the grinding bed can be minimized, because an alignment of the injected water flow can be done in the most effective area.

As prescribed by a particularly advantageous configuration of the invention, there are the means 9 to rotate and/or radially shift the water lance 3 subject to at least one operating parameter. The variation of the power consumption of the drives for the grinding table 1 and/or the grinding rollers 2, variations in the hydraulic pressure of the grinding rollers 2, grinding bed height or theoretical charge shoulder of the grinding rollers 2, for example, can be used as operating parameters.

The rotating water lance for water injection described above is particularly suitable for roller mills with alternating materials to be ground or materials to be ground with different characteristics.

The invention claimed is:

1. A roller mill for grinding material to be ground, comprising:

a grinding table configured to carry material to be ground on an upper surface thereof;

at least one grinding roller in communication with said grinding table and configured to roll over the upper surface of said grinding table to grind the material to be ground between the upper surface of the grinding table and an outer surface of said grinding roller; and a rotatable water lance disposed above the upper surface of said grinding table and in front of said grinding roller in the direction of rotation of said grinding table, and configured to apply water to the material to be ground that is carried on said grinding table; and a means for rotating said rotatable water lance so that the distance away from said grinding roller at which water is applied to said material to be ground may be selectively adjusted, in order to adjust the amount of time that the material to be ground is exposed to the applied water before the material to be ground is ground between said grinding roller and said grinding table.

2. The roller mill of claim 1, wherein said rotatable water lance includes a plurality of spray nozzles configured to spray water in the direction of said grinding table.

3. The roller mill of claim 2, wherein said water lance and said means for rotating said water lance are configured to adjust, by a rotation of said water lance, a length of time that the material to be ground is exposed to water applied from said water lance.

4. The roller mill of claim 1, further comprising a grinding track disposed in the upper surface of said grinding table in an operating area of said at least one grinding roller, wherein said rotatable water lance extends across said grinding track.

5. The roller mill of claim 1, wherein said water lance includes a longitudinal axis and is configured to be extendable about the longitudinal axis.

6. A method of operating a roller mill, comprising:

providing material to be ground to an upper work surface of a rotating grinding table, across which a grinding roller acts to grind material by rolling action there between;

applying water to the material to be ground by a rotatable water lance disposed in front of the grinding roller relative to a rotational direction of the grinding table, the rotatable water lance being configured to emit a spray of water therefrom and be rotatable to change the location, relative to the grinding table and grinding roller, at which water may be applied to the material to be ground;

rotating the water lance so as to change the location of impact along the grinding table of the applied water to the material to be ground, and thereby the distance from the grinding roller at which the material to be ground is initially exposed to the applied water, and thereby change the total length of time the material to be ground is exposed to water before it is ground between the grinding wheel and the grinding table; and grinding the wetted material to be ground between the grinding wheel and the grinding table.

7. The method of claim 6, further comprising:

setting, by the rotation of the water lance, the length of time between the impact of the applied water on the material to be ground and the moment at which the material to be ground is gathered by the grinding roller, subject to at least one operating parameter.

8. The method of claim 6, further comprising:

rotating the water lance during the active operation of the roller mill to adjust a length of time, subject to at least one operating parameter of the roller mill, that the material to be ground is exposed to water prior to being ground.

9. The method of claim 6, further comprising:

arranging the grinding roller and grinding table in a grinding chamber; and removing the water lance from the grinding chamber during the ongoing operation of the roller mill.

10. The method of claim 6, further comprising:

setting a rotational position of a first water lance to cause water emitted therefrom to impact the material to be ground at a first location in relation to a first grinding roller; and setting a rotational position of a second water lance to cause water emitted therefrom to impact the material to be ground at a second location in relation to a second grinding roller, wherein the rotational position of the first water lance is set independently of the rotational position of the second water lance.

* * * * *